United States Patent [19]

Matas Gabalda

[11] Patent Number: 4,549,393

[45] Date of Patent: Oct. 29, 1985

[54] MACHINE FOR CABLING YARNS AND IN PARTICULAR GLASS YARNS

[75] Inventor: Carlos Matas Gabalda, Granges les Valence, France

[73] Assignee: Asa S.A., Villeurbanne, France

[21] Appl. No.: 569,905

[22] Filed: Jan. 11, 1984

[30] Foreign Application Priority Data

Jan. 20, 1983 [FR] France ..... 83 01041

[51] Int. Cl.[4] ..... D02G 3/28; D02G 3/38; D02G 3/00; D01H 7/00

[52] U.S. Cl. ..... 57/58.36; 57/58.38; 57/58.83; 57/58.86; 57/80; 57/90

[58] Field of Search ..... 57/58.3–58.38, 57/58.83, 58.86, 90, 80, 81, 6, 12

[56] References Cited

U.S. PATENT DOCUMENTS

| | | | |
|---|---|---|---|
| 2,958,177 | 11/1960 | Seidl | 57/58.3 |
| 3,026,063 | 3/1962 | Seidl | 57/58.3 X |
| 3,880,001 | 4/1975 | Hogan | 73/16 C |
| 4,309,867 | 1/1982 | Ichikawa | 57/58.3 |

FOREIGN PATENT DOCUMENTS

| | | |
|---|---|---|
| 762818 | 7/1971 | Belgium . |
| 840367 | 6/1952 | Fed. Rep. of Germany . |
| 2556387 | 7/1976 | Fed. Rep. of Germany . |
| 1208273 | 9/1959 | France . |

*Primary Examiner*—John Petrakes
*Attorney, Agent, or Firm*—Parkhurst & Oliff

[57] ABSTRACT

The invention relates to a machine for producing a cabled yarn from two strands supplied from different supply sources. The two strands are twisted together over a freely rotatable roller disposed on the same axis as the upper bobbin, and the yarns which have been joined on the doubling roller, are subjected before winding, to the action of a compensating system which absorbs variations of tension and is adapted to actuate means for stopping the machine if one of the strands should break.

5 Claims, 3 Drawing Figures

MACHINE FOR CABLING YARNS AND IN PARTICULAR GLASS YARNS

BACKGROUND AND SUMMARY OF THE INVENTION

The present invention relates to an improvement in yarn cabling machines and more particularly in machines used for cabling glass yarns, namely machines producing very long textile elements resulting from the twisting together of at least two strands.

The invention relates more particularly to an improvement made in the machines such as described in French Pat. No. 1 208 273.

More generally, the aforesaid French Patent describes, as diagrammatically illustrated in accompanying FIG. 1, a cabling machine in which every working position comprises an assembly similar to unwinding double twist spindles (or DT assembly) permitting to twist together the two strands (A-B) supplied from two supply sources (1) and (2). In the device, the feeding bobbins (1) and (2) supplying the two strands (A) and (B) are placed one below the other. The yarn (A) supplied from bobbin (1) goes through a similar rotary plate (3) so as to form a balloon (4) inside which is situated the feeding source (2) supplying the strand (B). Strands (A) and (B) are twisted together at their meeting point (5) and the formed cabled yarn (6) is wound in conventional manner, for example by a throwing type winding (7).

The supply of the two strands (A) and (B) constituting the cabled yarn (6) is initiated by the winding speed in (7) and tensioning devices (8,9) are provided for each of said strands (A) and (B) in order to equalize the tensions and to obtain a balanced assembly.

The system used to assemble the two strands at meeting point (5) essentially comprises, as illustrated in FIGS. 1, 2 and 3 of the aforecited patent, a rotary "ply head", mainly constituted by a U-shaped support comprising two parallel branches of different length. This support is mounted on a ball bearing and is rotatable. Grooved pulleys are mounted on said support for guiding the yarns, the two strands being twisted together downstream. The support is driven in rotation directly by the balloon of the strand passing through an opening provided in the longest lower branch.

This type of machine is on the whole satisfactory although it has been found, especially in the case of glass yarns, that the variations of tension which are liable to occur when winding the cabled yarn could cause irregularities and even breakages in said yarn.

In addition, the system which is used to join the two strands is complex and is liable to continue working even if one of the strands, constituting the cabled yarn, breaks.

It has now been found, and this is the object of the present invention, to improve the cabling machines of the aforementioned type in such a way as to overcome the aforesaid disadvantages and in particular to obtain a regular and constant tension on the strands, as well as to stop automatically the machine if one of the strands constituting the cabled yarn should break.

In general, the cabling machine according to the invention differs from that described in the aforementioned French Patent, in that:

on the one hand, the two strands of yarn are twisted on a roller mounted for free rotation and situated in the axis of the upper bobbin, the strands being in contact with part of the peripheral surface of said guide and, on the other hand, the twisted strands are subjected, after their passage over the joining guide and before winding, to the action of a compensating system which can absorb the variations of tension and can actuate means of controlling the stoppage of the machine if one of the strands constituting the cabled yarn, breaks.

According to a preferred embodiment of the invention, the tension compensating system is constituted by a lever arm mounted for pivoting on the frame of the machine, the arm comprising at its free end, a yarn-guiding wheel, which, in normal operation, is disposed so that the resulting cabled yarn travels up the rotary doubling guide over about a quarter of its periphery, said arm being subjected to the action of a return spring (or like member), so that it is freely pivotable between two limit positions on either side of a balancing point, positions beyond which it can actuate the means controlling the stoppage of the machine.

BRIEF DESCRIPTION OF THE DRAWINGS

The invention will be more readily understood on reading the following description with reference to the accompanying drawings in which.

Figure 1:
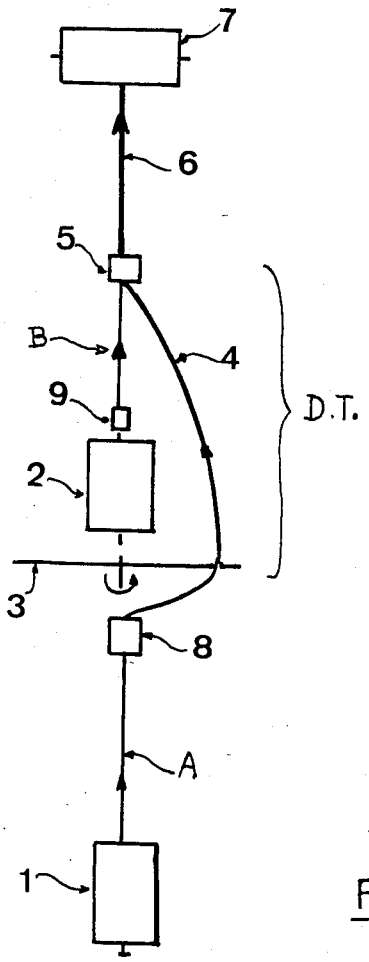
FIG. 1 diagrammatically illustrates a working position of a cabling machine according to the invention.

DETAILED DESCRIPTION OF THE PREFERRED EMBODIMENT:

Referring now to the drawings, these show that the cabling machine according to the invention comprises, in the same way as that described in French Pat. No. 1 208 273, a system similar to an unwinding double twist spindle permitting to twist together two elementary strands A and B supplied from two supply sources (1,2) placed one beneath the other.

Strand (A) supplied from bobbin (1) passes through a rotary assembly (3) so as to form a balloon (4) inside which is situated source (2) supplying strand (B), the two strands (A) and (B) being twisted together at meeting point (5).

Stretching or tensioning systems (8,9) are provided for each strand.

Figure 2:
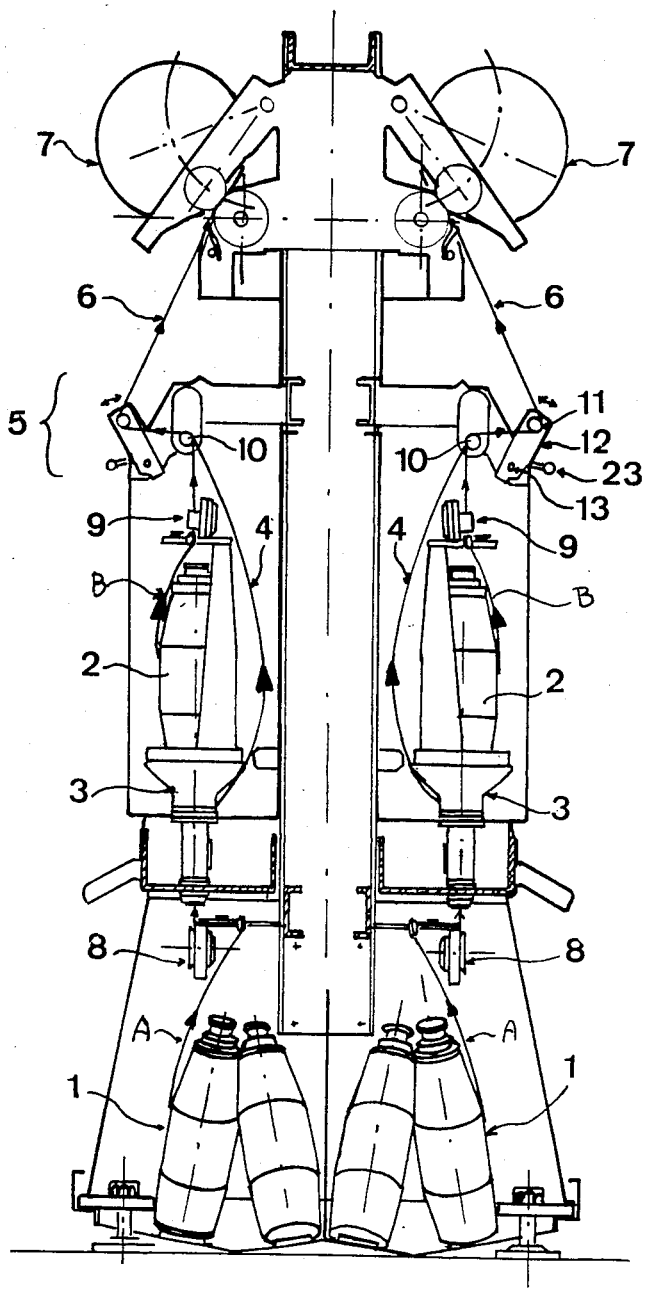
FIG. 2 is a side view showing in more detail a cabling machine according to the invention, in which the working positions are situated symmetrically on either side of a support frame of a known type.

As clearly shown in FIG. 2, the meeting zone (5) is constituted, in the illustrated example, by an assembly consisting of a guide (10) mounted for free rotation and placed substantially on the axis of bobbin (2) above stretching element (9). The two strands (A) and (B) are joined together on this guide (10), both strands coming into contact with part of its periphery.

Figure 3:
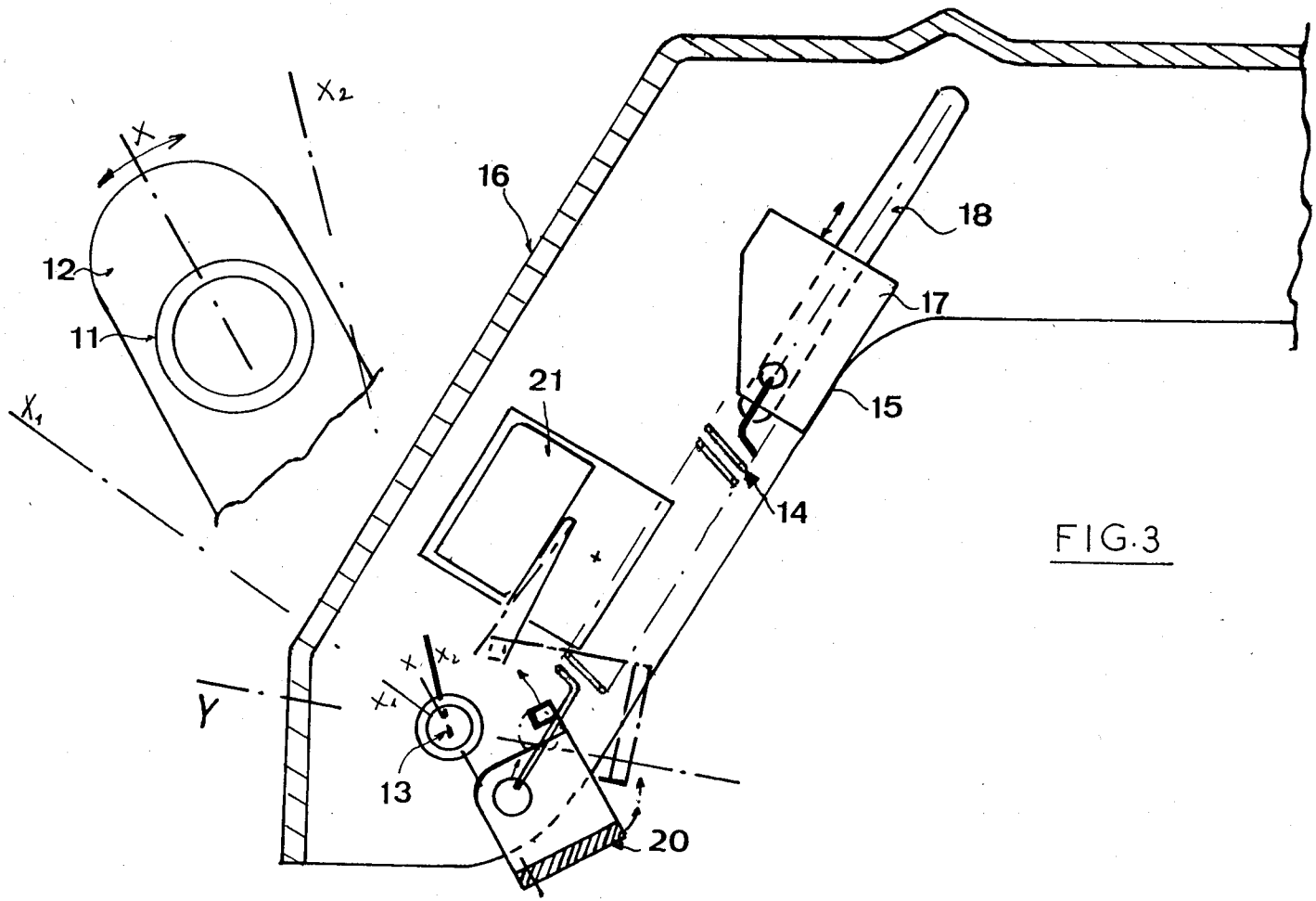
FIG. 3 is a diagrammatical cross-section showing the structure of a tension-compensating device used on a cabling machine according to the invention, and how such device works.

Also, according to the invention, the two strands having been twisted together on guide (10), the cabled yarn (6) resulting from the twisting together of the two strands on guide (10), is not brought directly to the winding means (7) but instead passes over a compensating assembly, the structure and working of which are illustrated in FIG. 3. The compensating assembly is essentially constituted by an arm (12) pivoting about a fixed axle (13). The pivoting arm (12) is subjected to the action of a return spring (14) of which the pulling force can be adjusted, for example by altering the positioning of the end (15) of the spring. The modification of the pulling force can be obtained, simply, as illustrated in FIG. 3, by securing said spring on the support member (16) via an assembly (17) adapted to slide through an opening (18) provided in said support member (16). The other end of spring (14) is secured to the base (20) of the pivoting lever (12). At the opposite end of the lever is mounted a guide-pulley (11) around which passes the cabled yarn (6). In the illustrated example, the compensating element is so designed that the path followed by the cabled yarn when the latter passes over the doubling guide (10) is such that the yarn covers up the doubling guide (10) over about a quarter of its periphery, to be thereafter deviated approximately at right angle to slide around guide (11). Thereafter, during normal operation, the compensating element can pivot between two outermost positions in relation to the variations in tension which can occur when winding. According to FIG. 3, the pivoting arm (12) is shown partly in its middle position in block lines whereas the outermost positions are just schematized by axes X1 and X2.

Also, according to the invention, the compensating device is adapted to automatically actuate means for stopping the working of the machine if one of the strands of the cabled yarn should break. Indeed, as illustrated in FIG. 3, if a strand breaks under the action of return spring (14), the compensating element is brought to the position shown in dash-and-dot line (axis Y) so that its base (20) actuates a relay (21) controlling the stoppage of the machine. Such stopping system is neutralized, when the machine starts working, by any suitable system such as for example by providing on the machine a manual member (handle 23) actuating a control (such as a cam) which pushes back the compensating arm out of the way of the contracting member (21).

It is possible with this particularly simple installation to work yarns such as glass yarns which are very sensitive to variations of tension known to cause not only defects in the resulting cabled yarn, but also frequent breaks.

The invention is in no way limited to the description given hereinabove and on the contrary covers any variants brought therein without departing from its scope.

What I claim is:

1. A yarn cabling machine for twisting two strands together into a cabled yarn and winding said cabled yarn, said cabling machine comprising:

a supply source for each strand, a first one of said supply sources being located downstream of a second one of said supply sources in a direction of strand travel;

means for tensioning each strand located downstream of each supply source, a first tensioning means being located between said first and second supply sources, and a second tensioning means being located downstream of said first supply source; and means for twisting said strands together into said cabled yarn, said twisting means being located downstream of said second tensioning means and including roller means rotatably mounted on an axis of said second supply source downstream of said second tensioning means, said strands contacting a portion of the peripheral surface of said roller means and being twisted together thereon; and compensating means for adjusting tension in the cabled yarn to maintain said tension substantially constant, said compensating means including means for deactivating said yarn cabling machine upon rupture of at least one of said strands.

2. The machine as claimed in claim 1, wherein the compensating means includes an arm having a free end and an opposite end pivotably mounted about a fixed axle, said arm being subjected to an adjustable biasing force of a return spring; and a guide-pulley located adjacent said free end on said arm, the cabled yarn passing around said guide pulley downstream of said roller means.

3. The machine as claimed in claim 2, wherein the guide pulley and roller means are positioned such that the cabled yarn passes over about a quarter of the peripheral surface of said roller means and is thereafter deviated approximately at a right angle to pass around said guide pulley.

4. The machine as claimed in claim 3, wherein the arm pivots between two outermost positions in relation to the variations in tension which occur when winding said cabled yarn, said arm being adapted to actuate said deactivating means for stopping the machine if one of the strands breaks.

5. The machine as claimed in claim 4, wherein means are provided for manually neutralizing the deactivating means when said machine is restarted.

* * * * *